US005937141A

United States Patent [19]

Swiatosz

[11] Patent Number: 5,937,141

[45] Date of Patent: Aug. 10, 1999

[54] SMOKE GENERATOR METHOD AND APPARATUS

[76] Inventor: Edmund Swiatosz, 335 Lake Seminary Circle, Maitland, Fla. 32751

[21] Appl. No.: 09/023,069

[22] Filed: Feb. 13, 1998

[51] Int. Cl.[6] ..... F22B 29/06; F23D 11/44; F24H 1/10

[52] U.S. Cl. ..... 392/397; 392/478; 431/208

[58] Field of Search ..... 392/386, 387, 392/394, 396, 397, 478, 480, 481, 482, 488, 489; 122/4 A, 13.2, 487; 137/341; 431/208

[56] References Cited

U.S. PATENT DOCUMENTS

| | | | |
|---|---|---|---|
| 1,373,809 | 4/1921 | Hadaway, Jr. | 392/397 |
| 3,851,146 | 11/1974 | Bennett | 392/397 |
| 4,547,656 | 10/1985 | Swiatosz et al. | 392/397 |
| 4,558,196 | 12/1985 | Babasade | 392/397 |
| 4,568,820 | 2/1986 | Swiatosz | 392/397 |
| 4,764,660 | 8/1988 | Swiatosz | 392/397 |
| 4,818,843 | 4/1989 | Swiatosz | 392/397 |
| 4,847,469 | 7/1989 | Hoffmann et al. | 392/397 |
| 5,870,524 | 2/1999 | Swiatosz | 392/397 |

*Primary Examiner*—Teresa Walberg
*Assistant Examiner*—Sam Paik
*Attorney, Agent, or Firm*—William M. Hobby, III

[57] ABSTRACT

A smoke generator apparatus and method are provided in which the apparatus has a pump connected to a reservoir of liquid smoke agent and to an electrical resistance heating tube incorporated into an electrical circuit. The electrical resistance heater tube has first and second end portions. The first end portion has an inside tube diameter larger than the second end portion inside tube diameter. The heating tube is activated by a control circuit for activating the pump and the electrical circuit to thereby heat the electrical resistance heating tube and pump a fluid from a reservoir into the heating tube. A pressure relief valve located between the pump and the electrical resistance heating tube input portion helps control the pressure and works in combination with the multisized heating tube to allow a low thermal mass of heater for use of a high temperature smoke agent which can be used in an open flame environment. A method is provided which selects the smoke generator of the apparatus, activates the electric circuit of the selected smoke generator apparatus to thereby activate the electrical resistance heating tube to begin heating the tube, and activating the pump to pump the liquid smoke agent initially through a pressure relief valve and then upon heating up into the electrical resistance heating tube to produce smoke out the heating tube orifice.

18 Claims, 1 Drawing Sheet

SMOKE GENERATOR METHOD AND APPARATUS

BACKGROUND OF THE INVENTION

The present invention relates to a smoke generator apparatus and method and especially to the generation of smoke in a high temperature flame environment using an electrical resistance heating tube smoke generator.

Artificial smoke from smoke generators cannot be used for flame environment unless a special high temperature resistant smoke agent fluid is used. Only a few synthetic oils, such as Fyrquel 220, which is a synthetic oil made by AKZO Chemical, Inc., has been found acceptable for this purpose by the Navy for fire fighting training applications and more recently by civilian fire fighting trainers. These type trainers utilize non-smoking propane gas flames that have a need for supplemental training smoke for realistic training conditions. Another use for high temperature resistance smoke is for periodic leak testing of the many boiler systems that utilize high pressure vessels for leak testing and piping where cool down for leak testing is cost prohibitive and can be avoided by using high temperature smoke. So far, smoke agent fluid, such as Fyrquel 220, is the only material that is considered acceptable for the applications due to its high temperature resistance properties and relatively low toxicity.

This smoke agent currently requires special expensive equipment and cannot be used with existing conventional low cost, low temperature smoke generators. The reasons are not only its high operating temperature (about 550° C.), but also the tendency for the heated fluid to rapidly decompose with subsequent clogging when exposed to moisture or moist air at elevated temperatures above about 90°–200° C. Hence, it is necessary to avoid moisture contact with the heated smoke agent fluid in the smoke generator system during operation and cool-down (when the system is shutting down). The smoke agent fluid is particularly susceptible to moisture contamination during cool-down since the boiling chamber (or heating tube) experiences a negative pressure permitting moist air to enter the heater. One existing smoke generator avoids this by forcing superheated air through a nozzle and inject the smoke agent fluid into this high velocity air stream. This method avoids the clogging problem, but is expensive due to heated air as a high temperature heat source and the high (50 psi) air blower pressure. Also, it has a low heat efficiency since the heat energy is lost by the hot air medium existing out the nozzle with the heated vapors. This results in high temperatures at the orifice exit that would tend to interfere with the condensation required for effective smoke generation. It also results in a relatively large package size.

Another more recent method of smoke generation is to utilize an electrical resistance tube heater for a low cost, efficient smoke producing system. What make this system possible is a blower that cools the heater coil to temperatures below 90 to 200° C. very quickly when the power to the heater coil is shut off. During shutdown, the remaining hot fluid in the coil is initially boiled off and the coil is temporarily partially empty and subject to "stagnant heating" causing "cooking" of the wetted heater surfaces that are hottest near the outlet orifice. Over time, this would cause an accumulation of residue and require maintenance cleaning, primarily due to limitations of thermal mass on effective cool-down rate.

The conventional "low temperature" smoke generators are not amenable to the use of high temperature smoke agent due to their lengthy warm-up and cool-down times which presents residence (the time duration of fluid in contact with hot surfaces) heating problems. Another type of smoke generator utilizes a thin wall tube as an electrical resistance heater and has been used successfully for low temperatures of under 290° C. for non-flammable environments. One version of this type of smoke generator requires expensive temperature control considerations due to the relatively low heater mass and long tube length. Either a special fast responding temperature controller that senses resistance changes with temperature distribution along the tube length or a special heat conductive, electrically non-conductive coating is required which permits the use of a point source temperature sensor or thermostat. The coating, however, also increases the start-up heating time and shut-down cooling time. These two approaches preclude their use as a high temperature smoke generator due to the excessive high temperature residence time during transient start-up and/or shut-down and high temperature moisture contamination during cool-down.

A smoke generator suitable for low temperature smoke generation can be seen in my prior U.S. Pat. No. 4,818,843. This prior smoke generator utilizes a thin wall tube as an electrical resistance heater and utilizes a thin coating over the resistance heating tube which electrically isolates the coils of the coil electrical resistance heating tube while conducting heat through the coils from the hot to the cold end of the coiled electrical resistance heating tube. Other smoke generators can be seen in Applicant's U.S. Pat. Nos. 4,547,656 and 4,568,820.

The present method of smoke generation utilizes a combination of a pressure relief valve for transient start-up as the viscosity and pressure changes with time and selective sizing of a multi-size diameter heater tube to match the temperature gradient and change in viscosity along the length of the heater tube. This permits an extreme reduction in heater tube size and an order of magnitude reduction in thermal mass for extremely rapid cooling. This makes it possible to essentially avoid the stagnant heating problem during cool-down. It also provides a feasible method for a higher capacity smoke generator using 220 V power source).

SUMMARY OF THE INVENTION

A smoke generator apparatus and method are provided in which the apparatus has a pump connected to a reservoir of liquid smoke agent and to an electrical resistance heating tube incorporated into an electrical circuit. The electrical resistance heater tube has first and second end portions. The first end portion has an inside tube diameter larger than the second end portion inside tube diameter. The heating tube is activated by a control circuit for activating the pump and the electrical circuit to thereby heat the electrical resistance heating tube and pump a fluid from a reservoir into the heating tube. A pressure relief valve located between the pump and the electrical resistance heating tube input portion helps control the pressure and works in combination with the multisized heating tube to allow the use of a high temperature smoke agent which can be used in an open flame environment. A method is provided which selects the smoke generator of the apparatus, activates the electric circuit of the selected smoke generator apparatus to thereby activate the electrical resistance heating tube to begin heating the tube, and activating the pump to pump the liquid smoke agent through a pressure relief valve into the electrical resistance heating tube to produce smoke out the heating tube orifice.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
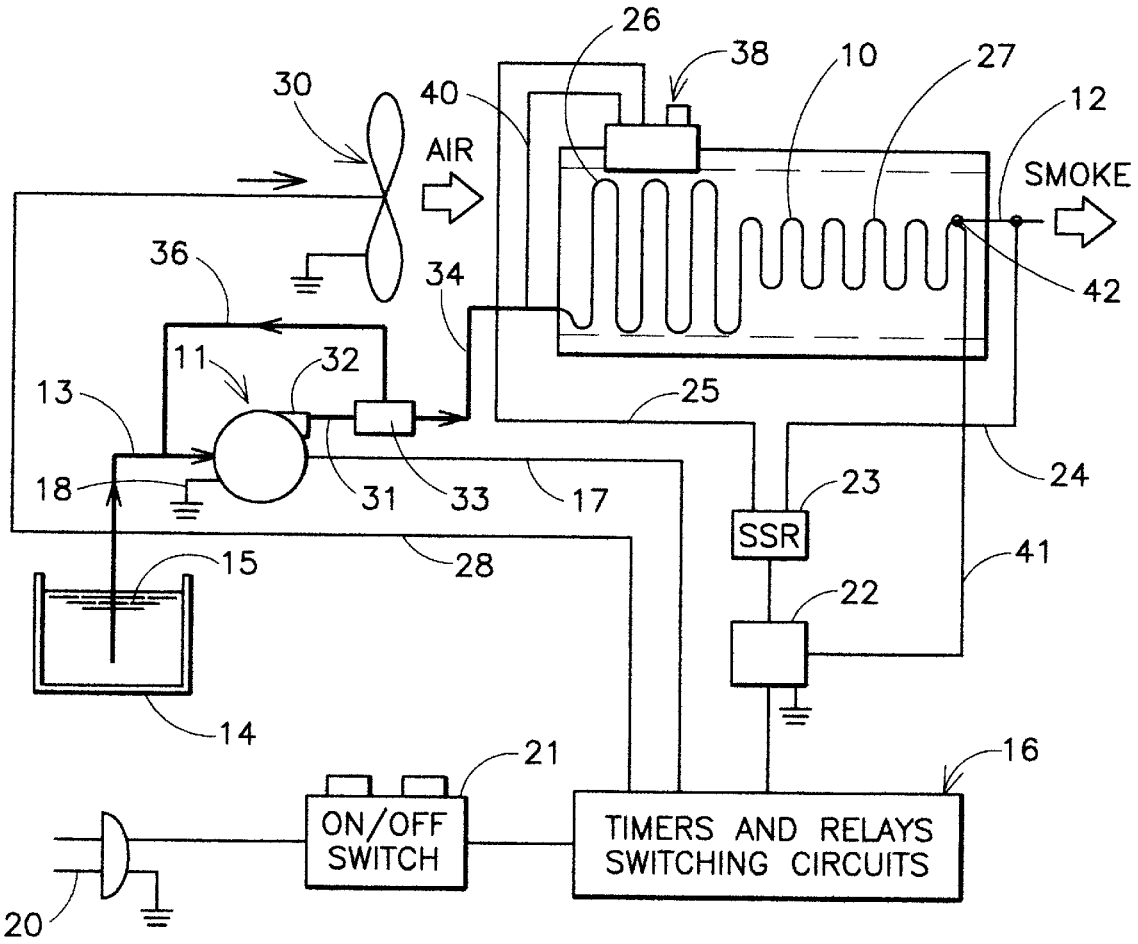
FIG. 1 is a schematic drawing of a smoke generator in accordance with the present invention.
Figure 2:
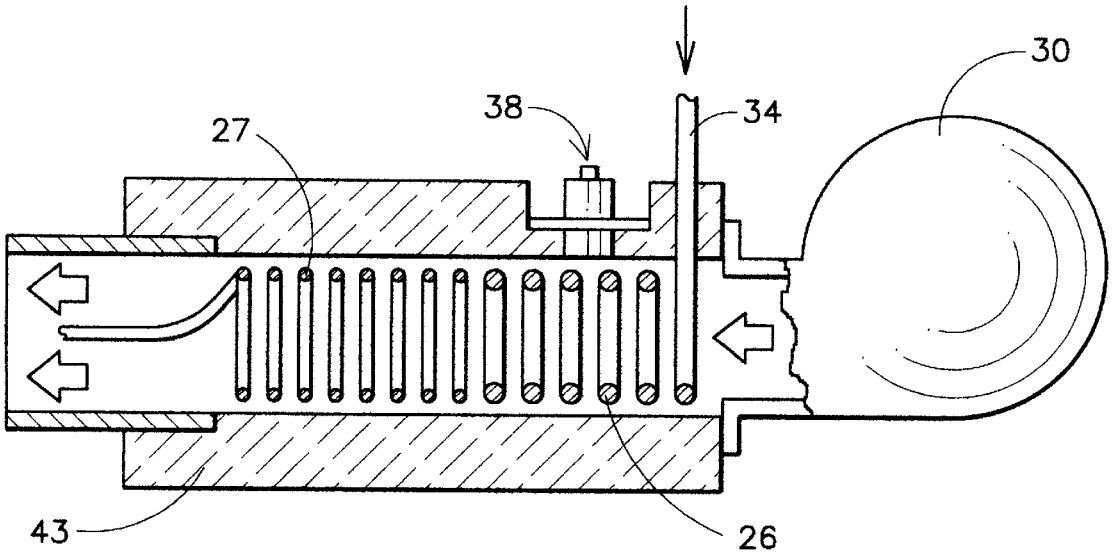
FIG. 2 is a sectional view of the heating tube.

Referring to FIGS. 1 and 2 of the drawings, an electrical resistance heater tube 10 within an insulation enclosure 42 is shown as a heating coil connected at one end to an electrical pump 11 and having an orifice outlet 12 at the other end thereof. Heater tube 10 is an Inconel alloy but can also be made of stainless steel or other metal as appropriate. The pump 11 is connected by a tube 13 to a liquid smoke agent reservoir 14 filled with a liquid smoke agent 15. The pump is also connected from a control or switch circuit 16 through an electrical conductor 17 and to a ground 18 so that the pump can be actuated by the circuit 16.

An electrical power source 20 connects to an on/off switch 21 which in turn is connected to the timer and relay switching circuits 16 which form part of the overall electrical circuit. The electrical circuit also includes a temperature controller 22 which maintains the set point temperature at the thermocouple location 42 along with a solid state power relay 23 which in turn connects through electrical conductors 24 and 25 to the electrical resistance heating tube 10. A set point temperature is sensed by thermocouple sensor 42 which is attached to heater coil 27 and is connected by thermocouple leads 41 to the temperature controller 22. The conductor 25 connects to a safety shutdown thermostat 38 through conductor 40 to the first end portion 26 of the tube 10 while the conductor 24 connects to the second end portion 27 of the tube 10. The timer and relay switching circuits 16 connect through a conductor 28 to a blower 30 which is a cooling blower directing air onto the heating tube 10. The pump 11 has a tube 31 connected from its output 32 to a pressure relief bypass valve 33. The pressure relief bypass valve 33 has a tube 34 connecting to the end 35 of the electrical resistance heating tube 10 at the end of the first tube portion 26. A feedback tube 36 connects from the pressure relief bypass valve 33 back to the tube 13 leading from the reservoir 14 so that pressure can be controlled by continuously feeding back fluid through the line 36 from one side of the pump 11 to the other side of the pump. The thermostat 38 is normally closed and has a manual reset feature so upon reaching a predetermined temperature, the thermostat switch contacts are opened to disconnect the electrical circuit from the resistance tube 10 to stop the heating of the tube. The thermostat 38 can be manually reset when the temperature drops below the thermostat setting.

The entire electrical circuit includes the on/off switch 21, timers and delay switching circuits 16, the temperature controller 22 as well as a solid state power relay 23 connected through conductors and the resistance tubing 10. The circuit also includes the wiring to the pump 11 and to the blower 30 which are each activated and controlled by the electrical circuit. The timing and switching circuit 16 consists of an interconnected set of five relays and a timer. One relay is a power contactor which is activated by the momentary switch 21 and supplies the main heater current and power for the remaining relays and timer. A second relay provides power to start the pump after a signal is provided by the temperature controller 22 effectively delaying pump operation until a predetermined temperature (other than the set point) is reached. Another relay switches on an interval timer for operating the blower 30 when the heater is shutdown. A fourth and fifth relay are required for shutdown by the safety shutdown thermostat 38 to operate the blower and timer and end of blower operation.

The operation is initiated by pressing the on/off switch 21 that closes the appropriate relay in the circuit 16 which starts a multi-size electrical tubular resistance heater 10 to start increasing the temperature in the tube 10. After a predetermined delay of 5–10 seconds, the pump 11 is started by the circuit 16 to start the fluid 15 flowing from the reservoir 14 through the pump 11 and through the pressure relief bypass valve 33 and into the resistance heating tube 10. During this time, the heater tube is partially full of fluid from the previously operation of the smoke generator or from the initial priming of the heater coil 10 and the temperature and pressure of the fluid rises rapidly to produce vapor within approximately 10 seconds. The vaporized smoke agent exits out the orifice 12 and condenses to produce the smoke. To terminate the smoke generating operation, the "off" button of the on/off switch 21 is pressed which shuts down both the heater and the pump and automatically turns on the cooling blower 30 for a predetermined period, such as 3–5 minutes, for cooling the coils 10. During the initial start-up and near the cool inlet end of the coils during shutdown, the fluid viscosity is highest and pump pressure limits would be greatly exceeded. Hence, the pressure relief by-pass valve operation is part of the start-up procedure.

In previous smoke generators, the heater coil is sized for the high viscosity conditions during low temperature start-up. Thus, by using a pressure relief valve it permits sizing the output heater coil portion 27 for the high temperature and low viscosity conditions thereby greatly reducing the thermal mass of the heater. This permits a much faster cooling after shutdown and subsequent reduction in cooling time of stagnant fluid to avoid thermal breakdown of the fluid. The pressure relief valve 33 is active during the times that the fluid temperature is near room temperature during initial startup and just before cool down is completed. There will be a temperature gradient along the tube 10 during normal steady state operation. Hence, the cold inlet end 26 of the heater will still result in high pressure and the large diameter is necessary at this location to avoid the high pressure. The operation of the smoke generator depends on the active operation of the pressure relief valve 33 as normal operation during transient heating before steady state operations. The normal operation of the relief valve 33 is used as a prevention of abnormal high pressures due to unintentional line blockage. A multi-sized heater coil 10 is necessary to match the change in fluid viscosity along the heater tube length in steady state operation. The heater tube used has a larger diameter tube 26 at the first part of the tube 27 with a small inside diameter tube 27 at the output end of the tube 10.

It will, of course, be clear that the coil tube 10 can also vary the diameter in degrees from one end to the other without departing from the spirit and scope of the invention. In addition, the larger tube 26 at the beginning of the tube 10 is wound in a larger coil while the tube at the second end portion 27 is wound in a smaller coil. One advantage of using the coil is that it allows a smaller length of tubing 10 for a more compact unit.

A safety shutoff thermostat 38 is provided with manual reset capabilities and mounted adjacent the larger tubing portion 26 or cold end of the tube 10 adjacent the inlet to the heater. This location of the thermostat is subjected to lower temperature and the set point could be, for instance, 190° C. depending upon the smoke agent and the tubing. In normal operation, there is a temperature gradient along the heater tube so that the thermostat will not be activated. The thermostat will be activated under either of two abnormal conditions. If there is a loss of fluid flow during operation and the temperature rises at the inlet side of the heater tube 10, the thermostat will be activated from a normally closed to an open position to shut off the heater current. The thermostat is not manually reset until the flow problem is rectified to add the cool fluid from the reservoir or the pump is repaired. If there is a temperature control problem, such as a thermocouple or temperature controller being defective, this can cause the output side of the heater to increase beyond the set point temperature, such as 510° C. In this case, the temperature gradient along the tube will increase and activate the thermostat to shut off the heater current and protect the heater from damage. In both cases, shutdown will cause the cooling fan to be activated to prevent chemical breakdown of the fluid due to the stagnant temperature heating effect.

The present invention advantageously utilizes a unique active by-pass pressure relief system and a multisize heater tube to miniaturize the heater's thermal mass and blower while avoiding a high pressure pump for a more cost effective system. The smoke generator also permits the use of higher output heaters using a higher voltage and the use of smaller diameter heater coil tubings. Faster cooling times are provided due to the smaller mass of the heater coil and fluid essentially eliminating formation of decomposition products to avoid clogging of the tube. The smoke generator avoids clogging that would normally occur if previous resistance tube type smoke generator system were used with a high temperature smoke agent. This allows the smoke generator to be used in a flame environment.

It is understood that an alternative simplification is available. The present invention description indicates a thermocouple sensor on the output end of the heater coil for maintaining a set point temperature for the temperature controller, thus providing an adjustable smoke output. This feature can be deleted and a lower cost fixed flow is possible by deleting the temperature controller and simplifying the circuitry. For this case, only one pump setting can be used at a flow rate that results in the 510° C. temperature set point.

It should be clear at this time that a non-flammable high temperature smoke generator apparatus and method of operation have been provided utilizing a high temperature smoke agent. However, the present invention is not to be construed as limited to the forms shown which are to be considered illustrative rather than restrictive.

I claim:

1. A smoke generator comprising:

a fluid reservoir;

an electrical power source;

an electric pump connected to said electrical power source and to said fluid reservoir by a fluid line for pumping fluid from said reservoir when said pump is actuated;

an electrical circuit;

an electrical resistance heating tube having first and second end portions, said first end portion having a first inside tube diameter and said second end portion having a second inside tube diameter smaller than the first inside tube diameter and said electrical resistance heating tube forming an electrical resistance in said electrical circuit, and said heating tube being connected at the first end portion thereof to said pump for receiving a fluid pumped from said reservoir, and said heating tube having a smoke outlet orifice in the second end portion thereof; and a control circuit for activating said pump and said electrical circuit to thereby heat said electrical resistance heating tube and pump a fluid from said reservoir into said electrical resistance heating tube to generate smoke from said smoke outlet orifice, whereby smoke is generated by heating a fluid in a heating tube and discharging the smoke therefrom.

2. A smoke generator in accordance with claim 1 having a pressure relief valve located between said pump and said electrical resistance heating tube first portion for controlling the pressure of fluid being fed from said fluid reservoir to said heating tube.

3. A smoke generator in accordance with claim 2 in which said pressure relief valve includes a feedback loop for feeding fluid from said pressure relief valve to said fluid line between said reservoir and said pump.

4. A smoke generator in accordance with claim 2 including an air blower connected to said electrical circuit and positioned to blow air onto said electrical resistance heating tube when said heating tube is being cooled down.

5. A smoke generator in accordance with claim 4 in which said electric circuit includes a delay circuit to delay activating said pump for a predetermined period after activating said smoke generator.

6. A smoke generator in accordance with claim 5 in which said electrical resistance heating tube is a coiled Inconel tube.

7. A smoke generator in accordance with claim 5 including an on/off switch for activating said electric pump and electrical circuit.

8. A smoke generator in accordance with claim 7 including a thermostat mounted adjacent said electrical resistance heating tube first end portion and coupled to said electrical circuit to shut off the electric power to said electrical resistance heating tube upon the heat reaching a predetermined level.

9. A smoke generator in accordance with claim 7 in which said thermostat is a manual resetting thermostat.

10. A smoke generator in accordance with claim 1 in which said electrical resistance heating tube is a coiled tube having the first portion coiled in a larger diameter than the second portion.

11. A smoke generator in accordance with claim 1 including a thermocouple connected to said electrical resistance heater tube and said control circuit.

12. A method of generating smoke comprising the steps of:

selecting a smoke generating apparatus having: a fluid reservoir having a liquid smoke agent therein, an electrical power source, an electric pump connected to said electrical power source and to said fluid reservoir for pumping fluid from said reservoir when said pump is actuated, an electrical circuit, an electrical resistance heating tube having first and second end portions, said first end portion having a first inside tube diameter and said second end portion having a second inside tube diameter smaller than the first inside tube diameter and said electrical resistance heating tube forming an electrical resistance in said electrical circuit, and said heating tube being connected at the first end portion thereof to said pump for receiving a liquid smoke agent pumped from said reservoir, and said heating tube having a smoke outlet orifice in the second end portion thereof, and a control circuit for activating said pump and said electrical circuit to thereby heat said electrical resistance heating tube and pump a fluid from said reservoir into said electrical resistance heating tube to generate smoke from said smoke outlet orifice;

activating said electrical circuit to heat said electrical resistance heating tube; and activating said pump to pump a liquid smoke agent into said electrical resistance heating tube to produce smoke out said heating tube orifice from said liquid smoke agent.

13. A method of generating smoke in accordance with claim 11 including the step of regulating the pressure of said smoke agent with a pressure relief valve located between said pump and said electrical resistance heating tube.

14. A method of generating smoke in accordance with claim 13 including the step of feeding back liquid smoke agent from said pressure relief valve to said fluid line between said fluid reservoir and said pump.

15. A method of generating smoke in accordance with claim 13 including the step of activating an electric blower to blow air over said heating tube upon turning off said heating tube.

16. A method of generating smoke in accordance with claim 15 including the step of delaying the activation of said pump for a predetermined period after activating said smoke generator.

17. A method of generating smoke in accordance with claim 13 including the step of selecting a smoke generating apparatus having an electrical resistance heating tube of coiled Inconel tube.

18. A method of generating smoke in accordance with claim 12 in which the step of selecting a coiled electrical resistance heating tube having the first portion coiled in a larger diameter than the second portion.

* * * * *